US010632778B2

(12) United States Patent
Martorana et al.

(10) Patent No.: US 10,632,778 B2
(45) Date of Patent: Apr. 28, 2020

(54) TACKY MICROPOROUS TRANSFER MATERIAL

(71) Applicant: SCHOELLER TECHNOCELL GMBH & CO. KG, Osnabruck (DE)

(72) Inventors: Emanuele Martorana, Hagen (DE); Sebastian Scholz, Osnabruck (DE); Rainer Gumbiowski, Wallenhorst (DE); Knut Hornig, Ladbergen (DE)

(73) Assignee: Schoeller Technocell GmbH & Co. KG, Osnabruck (DE)

( * ) Notice: Subject to any disclaimer, the term of this patent is extended or adjusted under 35 U.S.C. 154(b) by 0 days.

(21) Appl. No.: 16/347,920

(22) PCT Filed: Sep. 25, 2017

(86) PCT No.: PCT/EP2017/074240
§ 371 (c)(1),
(2) Date: May 8, 2019

(87) PCT Pub. No.: WO2018/091179
PCT Pub. Date: May 24, 2018

(65) Prior Publication Data

US 2019/0263164 A1 Aug. 29, 2019

(30) Foreign Application Priority Data

Nov. 16, 2016 (EP) ..... 16199112

(51) Int. Cl.
*B41M 5/035* (2006.01)
*B41M 5/025* (2006.01)
(Continued)

(52) U.S. Cl.
CPC ..... *B41M 5/0355* (2013.01); *B41M 5/0256* (2013.01); *B41M 5/035* (2013.01);
(Continued)

(58) Field of Classification Search
CPC .. B41M 5/0256; B41M 5/035; B41M 5/0355; B41M 5/5254; B41M 2205/02; B41M 2205/42
See application file for complete search history.

(56) References Cited

U.S. PATENT DOCUMENTS

| | | | | |
|---|---|---|---|---|
| 10,003,142 | B1 | 6/2018 | Lin | |
| 10,265,986 | B2 * | 4/2019 | Kuhne | B41M 5/0256 |
| 2017/0305178 | A1 | 10/2017 | Kuhne et al. | |

FOREIGN PATENT DOCUMENTS

| | | |
|---|---|---|
| DE | 102014116550 | 5/2016 |
| DE | 102017116550 | 5/2016 |

(Continued)

OTHER PUBLICATIONS

Written Opinion of the International Searching Authority for PCT/EP2017/074240 dated Dec. 22, 2017.

(Continued)

*Primary Examiner* — Gerard Higgins
(74) *Attorney, Agent, or Firm* — Honigman LLP; Andrew N. Weber; Jonathan P. O'Brien

(57) ABSTRACT

The invention relates to a transfer material for the dye sublimation transfer method (sublimation paper) for printing an inkjet print image, comprising a substrate and an ink receiving layer, which layer contains a pigment and a binding agent, on the front face of the transfer material, the ink receiving layer being porous and thermoplastic particles being arranged on the ink receiving layer. The porous ink receiving layer, together with the thermoplastic particles arranged thereon, have an air permeance according to Bendtsen of greater than 100 ml/min and the thermoplastic particles have a diameter of 0.3 μm to 5 μm and a melting point of 60° C. to 170° C.

14 Claims, 2 Drawing Sheets

Figure 1:
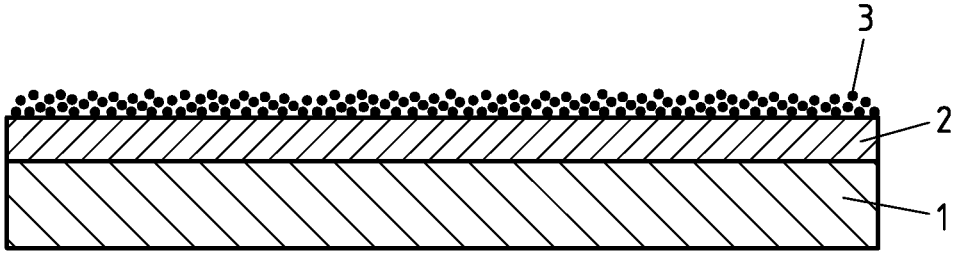

(51) Int. Cl.

| | |
|---|---|
| ***B41M 5/50*** | (2006.01) |
| ***D06P 5/28*** | (2006.01) |
| ***B41M 5/52*** | (2006.01) |

(52) U.S. Cl.

CPC ..... *B41M 5/506* (2013.01); *B41M 5/52* (2013.01); *D06P 5/004* (2013.01); *B41M 5/5254* (2013.01); *B41M 5/5272* (2013.01); *B41M 2205/02* (2013.01); *B41M 2205/38* (2013.01); *B41M 2205/42* (2013.01)

(56) References Cited

FOREIGN PATENT DOCUMENTS

| | | | | |
|---|---|---|---|---|
| EP | 0906832 | | 4/1999 | |
| JP | H07-96654 | | 4/1995 | |
| JP | 2002-292995 | | 10/2002 | |
| WO | WO-2016074671 | A2 * | 5/2016 | ..... B41M 5/0256 |

OTHER PUBLICATIONS

International Search Report for PCT/EP2017/074240 dated Dec. 22, 2017.

* cited by examiner

TACKY MICROPOROUS TRANSFER MATERIAL

TECHNICAL FIELD OF THE INVENTION

The invention relates to a sheet-like transfer material—which adheres easily to the receiving material during transfer—for the dye sublimation transfer method of an inkjet print image, comprising a substrate and an ink-receiving layer on the front face. Consequently, the invention pertains to a transfer paper intended for inkjet printing with sublimable dyes and from which paper the dyes are transferred after printing to a receiving material by means of thermal sublimation. The invention also pertains to the process of transferring an inkjet print image from the transfer paper referred to in the present invention to, for instance, a textile-based receiving material.

BACKGROUND OF THE INVENTION

Transfer printing processes are suitable for printing on materials such as textiles or rigid bodies, which for mechanical reasons are difficult to print on by direct printing methods. In the transfer printing method, an image is first printed on a flexible sheet-like transfer material and this printed image is subsequently transferred from the said transfer material onto the final object for which the print image is intended. A specific embodiment for this kind of transfer printing process is the dye sublimation process which, for instance, is described on page 468 in B. Thompson's "Printing Materials—Science and Technology" (1998). In this process, the image to be printed is applied to the transfer material using printing inks which, after the print has dried, are exposed to heat and allowed to evaporate such that the vapors are deposited as an image on the final material. Digital printing, in particular the inkjet printing process, is a convenient process that can be used for applying sublimation inks to the transfer material. A major benefit of this process is that it facilitates the printing of personalized images, for instance, on textiles.

Printing inks for inkjet printing with dyestuffs that are transferred through sublimation onto the final substrate are, for instance, described in DE 102 46 209 A1.

Paper is the preferred transfer material that is used in the first step in the inkjet printing technique. EP 1 101 682 A1 describes a type of coated paper that is characterized by a low level of air permeability on the side that is to be printed on. The purpose of this type of paper is to prevent the penetration of sublimable dyes into the porous interior of the paper and the consequent loss thereof during transfer onto the final substrate material. However, such types of paper with low porosity on the side that is to be printed on absorb the inkjet inks very slowly. As a result—and especially at high printing speeds—the ink dries very slowly, it can smudge on the surface and the printing resolution can thus be unsatisfactory.

In US 2008/229962 A1, therefore, a transfer paper coating that contains silica and a comparatively low amount of binders was proposed. Such a coating exhibits a significantly higher level of air permeability. This allows the ink to be absorbed but prevents a loss of sublimable dyes in the interior of the paper when transferring the image onto the final substrate material.

So-called "tacky" (adhesive) transfer papers refer to products that adhere to substrates such as textiles when transferred by means of the sublimation process. These products are especially used for stretch fabrics (for instance, knitted fabrics) to prevent the formation of shadows (ghosting) and to reduce the number of rejects during textile printing. Typical applications include textile printing for sportswear. The purpose of this type of adhesion is thus to prevent a displacement of the printing medium with respect to the receiving material arranged on the printing medium and vice versa.

Such types of adhesive transfer paper with swellable, non-porous layers are described in EP 1 102 682 A1 and EP 1 878 829 A1. A disadvantage of such types of paper is that they require a very long time to dry.

A so-called thermal transfer (or thermal sublimation) paper is also described in DE 10 2014 116550 A1 in which the use of thermoplastic particles with a melting point of 35° C. to 150° C. and an average particle size of 0.3 μm to 5 μm in the thermal transfer layers is proposed. The aim of using thermoplastic particles is to optimize the adhesion of the thermal sublimation paper when printing on flat textiles. The thermal transfer layer described in this document has a binder content of 55% to 80% (dry weight) and may even contain pigments. Despite the presence of pigments, the binder content in this proportion ensures a sealed, film-like thermal transfer layer that is not porous. The disadvantage of the technique using the materials described above is that—in contrast to microporous layers—the rate of drying is significantly lower. Moreover, the thermoplastic particle content has to be rather high in order to ensure an appreciable level of adhesion in the first place. This can greatly impact the print quality (line sharpness) and the transfer quality (optical densities on textiles). Apart from this, it is not possible to independently control the level of adhesion on textile substrates and the print and transfer quality with this technique.

BRIEF SUMMARY OF THE INVENTION

The object of the invention is to provide a transfer paper that is intended for inkjet printing with sublimable dyes and that contains a fast-drying (microporous) transfer layer and displays excellent adhesion on textile materials.

This object is accomplished, according to the present invention, by a transfer material for the dye-sublimation transfer process of an inkjet print image, wherein the transfer material comprises a carrier or transfer substrate and an ink-receiving layer containing pigments and binders on the front face of the transfer material, wherein the ink-receiving layer is porous and contains thermoplastic particles, whereby the porous ink-receiving layer with the thermoplastic particles thereon has an air permeability greater than 100 ml/min according to the Bendtsen method, and whereby the thermoplastic particles have a diameter of 0.3 μm to 5 μm and a melting point of 60° C. to 170° C.

According to a preferred embodiment of the invention, the transfer material may include a barrier layer either on the reverse of the transfer material or between the carrier/transfer substrate and the porous ink-receiving layer.

Furthermore, the invention also pertains to a process for transferring an image onto a given surface, whereby the inkjet printing technique is implemented to print an image onto a transfer material according to the present invention and the image is transferred onto the given surface by sublimation.

The advantages of the present invention are a reduced number of thermoplastic particles, improved tack or adhesion control, minor impact on print and image transfer quality, very fast drying time and independent control of print quality and textile adhesion. Furthermore, even with good print quality this approach allows increased adhesion, if required. It is thus possible to obtain adhesion not only for knitted (stretch) fabrics but also for woven fabrics.

DETAILED DESCRIPTION OF THE INVENTION

The transfer papers according to the invention comprise a paper support with adhesive polymer particles applied at least on the printing side and an underlying porous ink-receiving layer. Optionally, a barrier layer is placed between the ink-receiving layer and the paper support or, preferably, on the surface of the paper support opposite to the ink-receiving layer.

Preferably, the support paper is an uncoated or surface-sized paper. In addition to cellulose fibers, the base paper may contain sizing agents such as alkyl ketene dimers, fatty acids and/or salts of fatty acids, epoxidized fatty acid amides, alkenyl or alkyl succinic anhydride, starch, tree resins, wet strength agents such as polyamine-polyamide-epichlorohydrin resins, dry strength agents such as anionic, cationic or amphoteric polyamides, optical brighteners, pigments, dyes, defoamers and other chemical additives commonly used in the paper industry. The base paper can be surface-sized. Polyvinyl alcohol or oxidized starch acts as a good sizing agent for this purpose. The base paper can be manufactured on a Fourdrinier or Yankee paper machine (cylinder paper machine) and can have a basis weight or grammage of 30 to 200 g/m$^2$, preferably 40 to 120 g/m$^2$. The base paper can be used in uncompacted or compacted (smoothed) form. Base papers with a density of 0.6 to 1.05 g/cm$^3$, preferably 0.7 to 0.9 g/cm$^3$ are particularly suited. Usually, a calendering machine is used to obtain a smooth finish.

All types of cellulose commonly used in the paper industry are suited for producing the transfer paper. Preferably, for the paper production an eucalyptus pulp with a fiber content of 10 to 35 wt. % and less than 200 μm after pulp refining and an average fiber length of 0.5 to 0.75 mm is used. It has been shown that the use of a pulp with a limited fiber content of fibers with size less than 200 μm reduces the loss in stiffness caused by fillers.

Hardwood pulp (NBHK—northern bleached hardwood kraft pulp) and softwood pulp may also be used. In addition to pulp fibers, natural or synthetic fibers may also be used for the production of the support paper. As far as other fibers are concerned, the fiber content in relation to the total fiber mass should preferably be less than 40% by weight and particularly preferred less than 20% by weight.

Fillers for sheet production of base paper can include, for example, kaolins, calcium carbonate in its natural state such as limestone, marble or dolomite, precipitated calcium carbonate, calcium sulfate, barium sulfate, titanium dioxide, talcum, silica, aluminum oxide and mixtures thereof. Calcium carbonate with a particle size distribution of minimum 60% less than 2 μm and maximum 40% less than 1 μm is particularly suited. In a special embodiment of the invention, calcite with a numerical particle size distribution of around 25% less than 1 μm and around 85% less than 2 μm is used. According to a further preferred embodiment of the invention, calcium carbonate with a numerical particle size distribution of at least 70%, preferably at least 80% less than 2 μm and maximum 70% less than 1 μm may be used.

One or more additional layers may be arranged between the support paper and the ink-receiving layer and/or barrier layer. Preferably such layers are layers containing a hydrophilic binder.

The ink-receiving layer on the side of the support paper that is to be printed on may be a porous or non-porous layer. In the context of the present invention, a porous ink-receiving layer contains air-filled cavities (pores) prior to printing. These pores can absorb ink very quickly under the action of capillary forces and thus facilitate fast drying of the print image. In contrast to film-like ink-receptive coatings, such porous ink-receiving layers possess a high number of pigment particles and a comparatively low quantity of (film-forming) binding agents.

Porous ink-receiving layers are characterized by high air permeability values that can be determined by the Bendtsen method. The pore volume of such ink-receiving layers can be established and determined, for instance, by means of fluid absorption measurements or mercury porosimetry.

The porous ink-receiving layers contain inorganic pigments and binders. Pigments with an anionic, neutral or weak cationic surface such as silica, calcium carbonate, kaolin, talcum, bentonite, aluminum oxides or aluminum oxide hydrates are preferred in particular.

Particulate polymeric compounds may also be present in the ink-receiving layer, whereby high-melting thermoplastic or thermosetting polymers are preferred. In yet another embodiment of the invention, the ink-receiving layer may also contain a mixture of two or more pigments. The pigments preferably have an average particle size of 100 nm to 30 μm and particularly preferred 200 nm to 10 μm.

Preferably the ink-receiving layer additionally contains a polymeric binder—in particular a hydrophilic binder. A water-soluble or water-dispersible composition may be used as a binding agent. Preferred binders are styrene copolymers, polyvinyl alcohol, starch, modified starch, polyvinyl acetate, acrylate or polyurethane dispersions. The pigment-to-binder mass ratio is 100:1 to 100:50 and preferably 100:40 to 100:2.

The weight of the coating on the ink-receiving layer preferably is 1 g/m$^2$ to 50 g/m$^2$, particularly preferred is 3 g/m$^2$ to 30 g/m$^2$. Air permeability determined according to the Bendtsen method is preferably greater than 100 ml/min, particularly preferred from 200 ml/min to 500 ml/min.

The adhesive polymer or thermoplastic particles are arranged on the surface of the ink-receiving layer. They do not constitute a part of the ink-receiving layer and are therefore not distributed within the ink-receiving layer. As opposed to the relevant state of the art, the number of thermoplastic particles can thus be reduced significantly while simultaneously ensuring excellent adhesive results. The diameter of the thermoplastic adhesive polymer particles may range from 0.3 to 5 μm, preferably 0.5 to 2 μm and, ideally, from 0.8 to 1.5 μm. The melting point of the adhesive polymer particles may amount from 60° C. to 170° C., preferably from 80° C. to 150° C. Preferably polyolefins and polyolefin copolymers should constitute the adhesive polymer particles. For this purpose, thermoplastic particles of ethylene and propylene, poly(meth)acrylates, acrylonitrile-butadiene-styrene polymers, polycarbonates, polyethylene terephthalates, polystyrene, polyvinyl chloride, polyamides and mixtures thereof may be considered.

The thermoplastic particles can be applied to the ink-receiving layer from an aqueous dispersion. The thermoplastic particles on the ink-receiving layer may have a basis weight of 0.3 g/m$^2$ to 5 g/m$^2$, preferably 0.5 g/m$^2$ to 3 g/m$^2$ and, ideally, 0.8 to 1.5 g/m$^2$.

As opposed to the state of the art, the reduced number of thermoplastic particles used present the advantage that neither the print nor transfer quality is compromised.

The ink-receiving layer and the adhesive polymer particles should preferably be applied to the paper substrate by means of aqueous coating compounds or dispersions, whereby all coating application processes customary in the paper industry may be implemented. In this regard, blade, squeegee, film press or curtain coating techniques are preferred. A multi-layer curtain coating process is particularly preferred. With this technique, the ink-receiving layer for the inkjet print and the layer with thermoplastic particles are simultaneously applied to the substrate or receiving layer. This way, the material can be manufactured easily and the adhesive strength can be adjusted precisely—thanks to the coating weight of the second layer that contains the thermoplastic particles—without compromising the print quality.

The coating mass may contain other common additives such as wetting agents, thickeners, rheological additives, dyes and optical brighteners.

The barrier layer is characterized by low air, gas and water vapor permeability. Air permeability of the barrier layer determined according to the Bendtsen method is less than 100 ml/min and preferably less than 25 ml/min. The barrier layer preferably contains one or more polymeric compounds. In a specific embodiment of the invention, the barrier layer contains one or more thermoplastic polymers, whereby high-melting thermoplastic polymers such as polyesters or polymethylpentene are particularly preferred. In this embodiment, the barrier layer can be applied by means of the hot-melt extrusion coating process.

In a particularly preferred embodiment of the invention, the barrier layer is formed by applying an aqueous solution or an aqueous dispersion of one or more water-soluble or water-dispersible film-forming polymers. Preferred polymers in this context include styrene copolymers, polyvinyl alcohols or polyvinyl acetate. In another preferred embodiment of the invention, the barrier layer contains polymers from renewable resources, for instance starch, modified starch and/or cellulose derivatives such as carboxymethyl cellulose (CMC).

The weight of the coating of the barrier layer is preferably from 1 $g/m^2$ to 40 $g/m^2$, ideally from 2 $g/m^2$ to 20 $g/m^2$.

The transfer material of the invention is also particularly suited for transferring a printed image onto polyester fabric, polyester fleece, a surface coated with a polyester layer or a polyester surface.

FIG. 1 shows a schematic representation of a cross-section of a microporous transfer paper according to the present invention. Herein 1 stands for a paper support. The porous or microporous ink-receiving layer 2 intended for inkjet printing contains a binder and an inorganic pigment. On top of the ink-receiving layer 2 a layer 3 with thermoplastic polymer particles is arranged.

Figure 2:
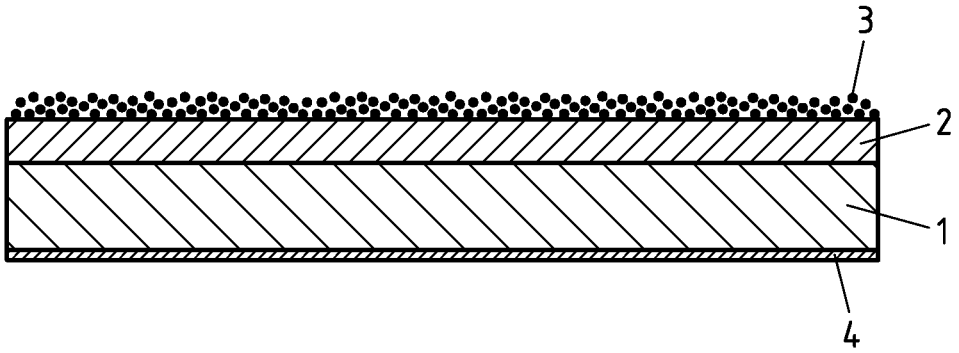

FIG. 2 shows another embodiment of the transfer paper of the invention in which a barrier layer 4 is positioned on the surface of the paper support facing away from the layer with the adhesive particles and the ink-receiving layer; in other words, the barrier layer is on the reverse of the paper support.

Figure 3:
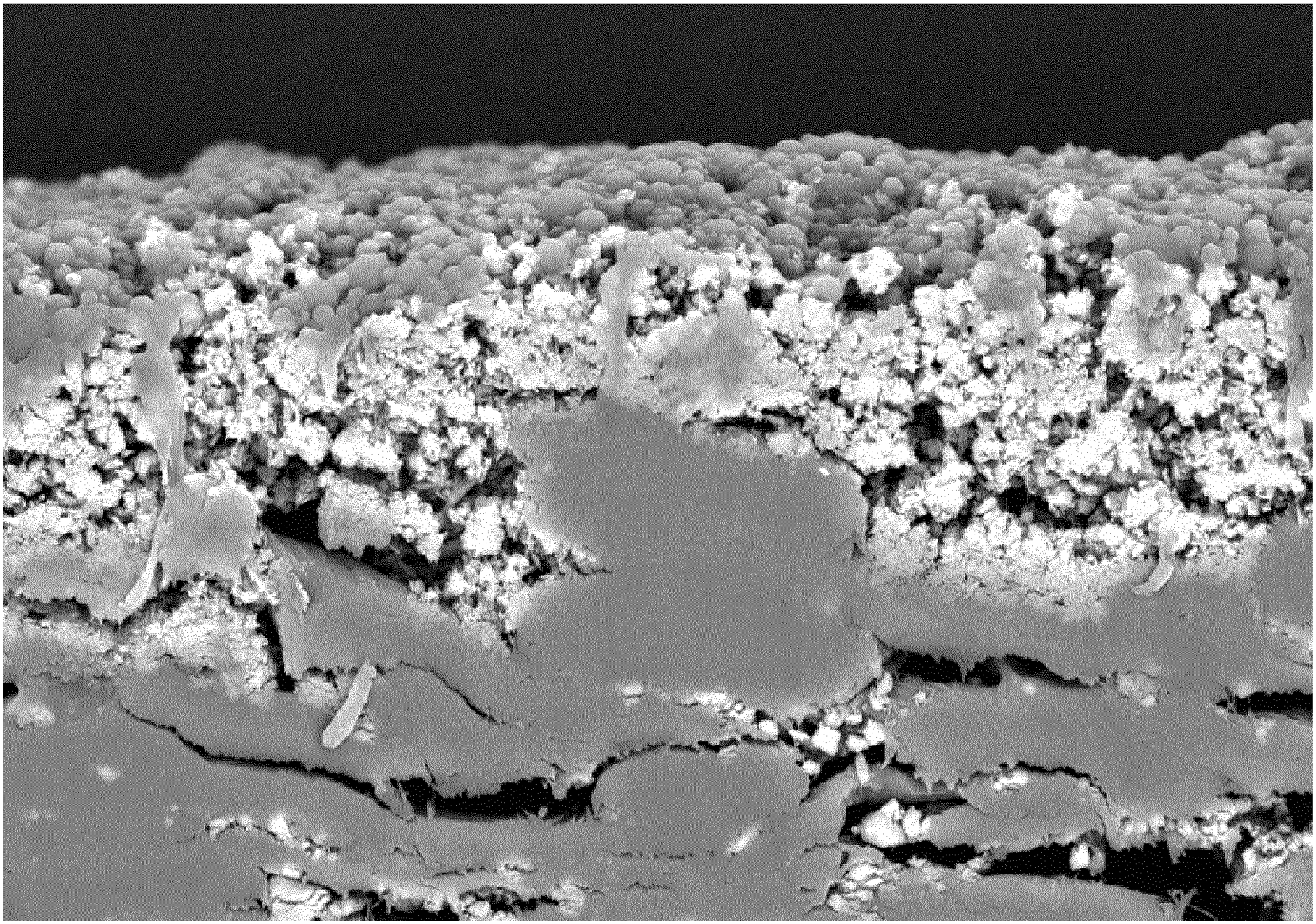

FIG. 3 is a scanning electron microscope image and shows the cross-section of a transfer paper according to the invention that was obtained by cutting the paper with a razor blade. The transfer paper depicted here is identical to that described in FIG. 1. In the scanning electron microscope image (device: Hitachi SU 3500, magnification 1,500 times, 15.0 kV, BSE detector), the paper fibers and the adhesive polymer droplets are darker (gray) than the calcium carbonate pigment particles (lighter). FIG. 3 clearly shows that the adhesive polymer particles are distributed on the receiving layer and not within the receiving layer.

The following examples and tests aim to provide a further explanation of the invention.

EXAMPLES

1. Manufacturing the Paper Support

Eucalyptus pulp was used for manufacturing the base paper. As approximately 5% aqueous suspension (thick stock), the pulp was beaten with a refiner to 26° SR. The concentration of the pulp fibers in the thin stock was 1% by weight in relation to the total weight of the pulp suspension. Further additives were introduced to the thin stock, for instance a neutral sizing agent alkyl ketene dimer (AKD, 0.23% by weight), wet strength agent polyamine-polyamide-epichlorohydrin resin (Kymene®, 0.60% by weight), starch (C*Bond HR 35845, 1.0% by weight) and natural ground $CaCO_3$ (15% by weight). The amounts indicated are in relation to the mass of the pulp.

The thin stock with a pH adjusted to about 7.5 was fed from the headbox to the wire of the paper machine. For sheet formation, the web was dewatered in the wire section of the paper machine. In the press section, the paper web was dewatered further to a water content of 60% by weight in relation to the web weight. Additional drying was carried out in the dryer section of the paper machine with the aid of heated cylinders. The final product was a base paper with a grammage of 90 $g/m^2$, a filler content of 10% by weight and a moisture content of approximately 5.5%.

In a size press, both sides of the base paper were surface sized with a starch solution containing 3% by weight C*Film 05731 starch manufactured by Cargill and water. The total weight of the starch applied on both sides is approximately 1.5 $g/m^2$. The base paper is once again dried and smoothed following the application of the starch coating. The base paper thus obtained displays an air permeability of 700 ml/min determined according to the Bendtsen method as specified in DIN 53120-1.

2. Manufacturing a Coating Mass for the Ink-Receiving Layer 557 g of an aqueous 9.5%-by-weight solution of a partially saponified polyvinyl alcohol (Mowiol® 18-88, Kuraray) is added to 441 g of a diluted dispersion of precipitated calcium carbonate (Precarb® 800, Schaefer Kalk) with a solids content of 48% by weight and the mixture is stirred with a dissolver agitator. Subsequently, 0.5 g wetting agent Surfynol® 440 marketed by Air Products is added to the mixture. The resulting coating material has a solids content of 26.6% by weight, a viscosity of 150 mPas, a pH value of 7.5 and a surface tension of 36 mN/m.

3. Manufacturing a Coating Compound with Thermoplastic Particles

A dispersion of polyolefin particles (HYPOD 2000 manufactured by Dow Chemical Company) is diluted with water to a solids content of 48% by weight. The glass transition temperature of the polyolefin particles (adhesive polymer particles) in the dispersion is −26° C. The average particle diameter of the adhesive polymer particles is around 1 μm. Furthermore, 4% by weight of Surfynol® 440 marketed by Air Products is added to the dispersion. The resulting coating material has a viscosity of 50 mPas, a surface tension of 33 mN/m and a pH level of 9.9. Together with the ink-receiving layer, the coating compound with the thermoplastic particles is applied as an aqueous dispersion using the curtain coating process.

4. Manufacturing a Coating Compound for the Barrier Layer 4 g wetting agent Surfynol® 440 from Air Products is added to 1000 g of a 10%-by-weight aqueous solution of saponified polyvinyl alcohol (Mowiol® 28-99).

5. Reference Material V1

A commercially available transfer material with a release and barrier layer (Transjet Sportsline 9310—100 g/m$^2$) serves as reference material V1. On the print side, this reference material possesses a non-porous coating that adheres to the fabric (industry benchmark for adhesion).

6. Reference Material V2

A commercially available transfer material with a microporous ink-receiving layer (Transjet Boost 8340—85 g/m$^2$) serves as reference material V2. Reference material V2 possesses a fast-drying, non-adhesive transfer layer (industry benchmark for drying).

7. Manufacturing Reference Material V3

A laboratory product according to the coating formulation described in Example 1 in DE 10 2014 116550 A1, namely thermoplastic particles in a binder-rich layer, applied to the base paper described under item 1 serves as reference material V3. The dry coating of the ink-receiving layer weighs 8 g/m$^2$.

8. Manufacturing a Transfer Paper with an Ink-Receiving Layer, Thermoplastic Particles and Base Paper (Invention E1)

The coating compound for the ink-receiving layer (Example 2) and the coating compound for the thermoplastic particles (Example 3) are simultaneously applied to the base paper described under Example 1, whereby the thermoplastic particles are distributed on the top side (i.e. on the side facing away from the base paper). The dry coating of the ink-receiving layer from Example 2 weighs 12 g/m$^2$ whereas that of the adhesive particles from Example 3 weighs 1 g/m$^2$.

9. Manufacturing a Transfer Paper with an Ink-Receiving Layer, Thermoplastic Particles and a Barrier Layer on the Reverse of the Base Paper (Invention E2)

In addition to the coatings for the transfer paper manufactured according to Invention 1, the coating described under Example 4 is also applied onto the transfer paper with the aid of a squeegee and allowed to dry. The dry coating weighs 5 g/m$^2$ and the coating is applied on the side of the base paper opposing the ink-receiving layer and the layer with the thermoplastic particles.

10. Test Methods

On the transfer materials obtained, a color image was printed with an EPSON WP-4015 inkjet printer and SubliJet IQ sublimation inks from Sawgrass.

The quality of drying after obtaining the inkjet print was assessed using two test methods:

a) Smearfastness test: After a specified time (fresh print, 30 seconds, 1 minute, 3 minutes, 5 minutes), the tester runs his/her finger over four full-color print fields in the colors cyan, magenta, yellow and black (CMYK) and assesses whether and to what extent the colors smear.

b) Imprint test: Immediately after printing, the CMYK full-color areas are brought into direct contact with the reverse of a second sheet of the transfer material and pressed with a 5-kg cylinder (Cobb cylinder). The tester subsequently performs a visual check to assess how much ink has passed through to the rear side of the second sheet.

Transfer of the printed image onto a fabric by sublimation:

In a Rotex AutoSwing X heat transfer press from Sefa, the image side of the printed transfer material is brought into contact with a knitted polyester fabric (sports jersey 140 g/m$^2$ from A. Berger, article no. 4245-3). A sheet of office copying paper with a grammage of 80 g/m$^2$ is additionally placed on the reverse of the transfer material in order to assess the ink bleed-through. At a temperature of 200° C., a contact pressure at level 30 according to the indicator on the heat transfer press is applied. The fabric and the copying paper are subsequently separated from the transfer material.

The print sharpness is assessed visually and with a microscope, both on the transfer material before the image transfer and on the fabric after the sublimation transfer.

The color density for the CMYK full-color fields is measured with a SpectroEye spectrophotometer from X-rite.

The ink bleed-through is visually assessed on the basis of the ink that is transferred onto the copying paper that was placed on the rear side during the sublimation transfer process.

The level of adhesion of the printed sublimation paper on a fabric after transfer printing in the transfer press is determined by separating the fabric from the paper by hand at an angle of 90° to 120° after the transfer process. The following scores were awarded, in accordance with DE 10 2014 116550 A1:

Grade 1: The pattern sticks strongly on the fabric.

Grade 2: The pattern sticks lightly on the fabric.

Grade 3: The pattern sticks very lightly on the fabric.

Grade 4: The pattern does not stick on the fabric.

Grade 5: The pattern can only be removed by damaging it.

Grade 6: The pattern can only be removed by destroying it.

11. Test Results (Test Methods and Equipment) for V1, V2, V3, E1 and E2

| | V1 | V2 | V3 | E1 | E2 |
|---|---|---|---|---|---|
| Air permeability (Bendtsen method, DIN 53120-1, issue 1998-06) | <25 ml/min | <25 ml/min | 120 ml/min | 355 ml/min | <25 ml/min |
| Drying (Average from smearfastness and imprint test) | −−− | ++ | − | +++ | +++ |
| Print quality (line sharpness) Before and after sublimation transfer to fabric | +/++ | +/++ | +/++ | +++/+++ | +++/+++ |

-continued

| | V1 | V2 | V3 | E1 | E2 |
|---|---|---|---|---|---|
| Transferred color density | ++ | ++ | ++ | ++ | +++ |
| Ink bleed-through to reverse | +++ | ++ | + | −− | +++ |
| Adhesion to fabric | Grade 1 (The pattern sticks strongly on the fabric.) | Grade 4 (The pattern does not stick on the fabric.) | Grade 1 (The pattern sticks strongly on the fabric.) | Grade 1 (The pattern sticks strongly on the fabric.) | Grade 1 (The pattern sticks strongly on the fabric.) |

The test results in the table show that the transfer materials according to the present invention exhibit very good drying properties after inkjet printing; demonstrate excellent line sharpness, even in the image transferred to the fabric; transfer the sublimation ink to a large extent to the fabric during the sublimation transfer process and additionally exhibit excellent adhesion on the fabric (E1). In this regard, it needs to be emphasized that the drying characteristics of the ink of E1 are far superior to those of V3 and even surpass those of V2. Hence, the adhesion on the fabric of V1 is achieved with the drying process of V2, to date, this was not possible with the prior art methods. The application of an additional barrier layer (E2) creates a product that displays outstanding characteristics in terms of all the essential quality aspects expected from sublimation paper. The use of a barrier layer (E2) ensures that only a very small quantity of ink is released through the rear side. Moreover, the barrier layer can be applied either on the reverse or on the top side of the base paper. The application of the barrier layer on the reverse side enhances the drying characteristics by exploiting the water absorption capacity of the paper support.

The invention claimed is:

1. A transfer material for the dye-sublimation transfer process of an inkjet print image (sublimation paper), wherein the transfer material comprises a support with a front face and a back face and an ink-receiving layer containing pigment and binder on the front face of the support, characterized in that the ink-receiving layer is porous and contains thermoplastic particles arranged thereon and not distributed within the ink-receiving layer, whereby the porous ink-receiving layer with the thermoplastic particles thereon has an air permeability from 200 ml/min to 500 ml/min according to the Bendtsen method, and whereby the thermoplastic particles have a diameter of 0.3 μm to 5 μm and a melting point of 60° C. to 170° C.

2. The transfer material according to claim 1, characterized in that the support is a paper support.

3. The transfer material according to claim 2, characterized in that the transfer material further includes a barrier layer either on the back face of the paper support or between the paper support and the porous ink-receiving layer.

4. The transfer material according to claim 3, characterized in that the barrier layer is arranged on the back face of the paper support that faces away from the ink-receiving layer.

5. The transfer material according to claim 3, characterized in that the air permeability of the barrier layer according to the Bendtsen method is less than 100 ml/min.

6. The transfer material according to claim 1, characterized in that a surface of the ink-receiving layer is negatively charged or neutral.

7. The transfer material according to claim 1, characterized in that the ink-receiving layer a surface of has pH value of at least 7.0.

8. The transfer material according to claim 1, characterized in that the ink-receiving layer contains a pigment selected from calcium carbonate, kaolin and silica.

9. The transfer material according to claim 3, characterized in that the barrier layer contains a water-soluble polymer.

10. The transfer material according to claim 3, characterized in that the barrier layer has a grammage of 2 $g/m^2$ to 20 $g/m^2$.

11. The transfer material according to claim 1, characterized in that the ink-receiving layer has a grammage of 3 $g/m^2$ to 30 $g/m^2$.

12. The transfer material according to claim 1, characterized in that the grammage of the thermoplastic particles on the ink-receiving layer is 0.3 $g/m^2$ to 5 $g/m^2$.

13. A method for transferring an image to a receiving material by means of sublimation, comprising printing an inkjet image onto a transfer material according to any one of claims 1 to 12; and transferring the inkjet image onto a surface of the receiving material by sublimation.

14. The method according to claim 13, characterized in that the surface of the receiving material is composed of polyester fabric, polyester fleece, a surface coated with a polyester layer or a polyester surface.

* * * * *